US012337364B2

(12) United States Patent
Yamashita et al.

(10) Patent No.: US 12,337,364 B2
(45) Date of Patent: Jun. 24, 2025

(54) BENDING DEVICE, PRODUCTION FACILITY FOR STEEL SHEET PILE, BENDING METHOD, AND PRODUCTION METHOD FOR STEEL SHEET PILE

(71) Applicant: NIPPON STEEL CORPORATION, Tokyo (JP)

(72) Inventors: Hiroshi Yamashita, Tokyo (JP); Shinya Hayashi, Tokyo (JP); Kazunori Seki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/800,179

(22) PCT Filed: Mar. 10, 2021

(86) PCT No.: PCT/JP2021/009618
§ 371 (c)(1),
(2) Date: Aug. 16, 2022

(87) PCT Pub. No.: WO2021/182529
PCT Pub. Date: Sep. 16, 2021

(65) Prior Publication Data

US 2023/0107517 A1 Apr. 6, 2023

(30) Foreign Application Priority Data

Mar. 10, 2020 (JP) ..... 2020-041323
Mar. 10, 2020 (JP) ..... 2020-041344

(51) Int. Cl.
*B21B 1/082* (2006.01)

(52) U.S. Cl.
CPC ..... *B21B 1/082* (2013.01)

(58) Field of Classification Search
CPC ..... B21B 1/082; B21B 1/095; B21B 27/02; B21B 35/02; B21B 2045/0254; B21B 1/088
See application file for complete search history.

(56) References Cited

U.S. PATENT DOCUMENTS 1,176,308 A * 3/1916 Mathias ..... B21D 5/08 29/90.01
4,291,564 A 9/1981 Muckli
(Continued)

FOREIGN PATENT DOCUMENTS

JP 46-10651 B1 3/1971
JP 50-43266 Y1 12/1975
(Continued)

OTHER PUBLICATIONS

JP 62-156001A, Furuta Jul. 1987.*
(Continued)

*Primary Examiner* — Edward T Tolan
(74) *Attorney, Agent, or Firm* — Birch, Stewart, Kolasch & Birch, LLP

(57) ABSTRACT

A facility cost and a remodeling cost can be reduced, and further, a steel sheet pile product with high dimensional accuracy is produced by suppressing occurrence of warpage of a material to be rolled during bending. There is provided a bending device which produces a steel sheet pile by performing bending on a material to be rolled after being subjected to rough rolling, intermediate rolling, and finish rolling in a hot state, in a direction of increasing a cross sectional height of the material to be rolled, the bending device including: a forming stand including a forming caliber configured by an upper caliber roll and a lower caliber roll; and a drive unit driving either the upper caliber roll or the lower caliber roll.

18 Claims, 12 Drawing Sheets

(56) References Cited

U.S. PATENT DOCUMENTS

| | | | | |
|---|---|---|---|---|
| 6,276,183 | B1 | 8/2001 | Benedetti et al. | |
| 9,452,459 | B2 * | 9/2016 | Daimaru | B21B 39/02 |
| 2020/0086367 | A1 * | 3/2020 | Hashimoto | B21B 1/082 |

FOREIGN PATENT DOCUMENTS

| | | | |
|---|---|---|---|
| JP | 54-122661 | A | 9/1979 |
| JP | 63-101006 | A | 5/1988 |
| JP | 11-156410 | A | 6/1999 |
| JP | 2000-334502 | A | 12/2000 |
| JP | 2003-230916 | A | 8/2003 |
| JP | 2008-229639 | A | 10/2008 |
| JP | 2009-279732 | A | 12/2009 |
| WO | WO 00/15363 | A1 | 3/2000 |

OTHER PUBLICATIONS

Translation JP 62-256001A, Furuta Jul. 1987.*
DE 4425595A1, Rainer Jan. 1996.*
JP 60-250804A, Fujimoto Dec. 1985.*
Translation JP 60-250804A, Fujimoto 12-2985.*
GB 2082490A, Miura Mar. 1982.*
JP 07-290121A, Miura et al. Nov. 1995.*
JP 05-317904A, Nishino et al. Dec. 1993.*
JP 04-172114A, Kusaba Jun. 1992.*
Translation JP 04-172114A, Kusaba Jun. 1992.*

* cited by examiner (a)

(b)

(c)

BENDING DEVICE, PRODUCTION FACILITY FOR STEEL SHEET PILE, BENDING METHOD, AND PRODUCTION METHOD FOR STEEL SHEET PILE

CROSS-REFERENCE TO RELATED APPLICATIONS

This application is based upon and claims the benefit of priority of the prior Japanese Patent Application No. 2020-41323 and the prior Japanese Patent Application No. 2020-41344, filed in Japan on Mar. 10, 2020, the entire contents of which are incorporated herein by reference.

TECHNICAL FIELD

The present invention relates to a bending device, a production facility for a steel sheet pile, a bending method, and a production method for a steel sheet pile.

BACKGROUND ART

Conventionally, a steel sheet pile of a hat shape or the like having joints at both ends thereof has been produced through a caliber rolling method. As a general step of this caliber rolling method, it has been known that a rectangular material is first heated to a predetermined temperature in a heating furnace, and then rolled in order by a rough rolling mill, an intermediate rolling mill, and a finish rolling mill including calibers. Further, when producing a large-sized and asymmetric product such as a hat-shaped steel sheet pile, in particular, a large number of calibers are required since shaping in a shape similar to the product shape is performed. On the other hand, only by the above-described rough rolling mill, intermediate rolling mill, and finish rolling mill, the number of calibers is insufficient, so that a deformation amount per caliber becomes large, resulting in that a shape variation and a defective shape of the product are likely to occur. For this reason, there is also known a method in which a device that performs bending (bending forming) is provided at a subsequent stage of the finish rolling mill, rolling is carried out in a step performed in the rough rolling mill to the finish rolling mill, and working is performed in the aforementioned device that performs the bending.

For example, Patent Document 1 discloses a technique in which a hat-shaped steel sheet pile is subjected to bending through cold working by roll forming, to thereby produce a steel sheet pile with a wide width, and a steel sheet pile with a high cross sectional height, which are beyond performance of a rolling facility.

PRIOR ART DOCUMENT

Patent Document 1: Japanese Laid-open Patent Publication No. 2003-230916

DISCLOSURE OF THE INVENTION

Problems to Be Solved by the Invention

As employed also in the cold working, the roll forming has working reaction force and torque which are smaller than those of rolling working, downsizing of a facility thereof can be realized, and if downsizing of a drive system (drive device) (for example, either upper or lower single-drive system), in particular, is realized, a facility cost can be greatly reduced. Further, bending is performed after a termination of finish rolling, and normally, it is desirable to perform the bending right after the termination of finish rolling, so that it is desirable to arrange a device that performs the bending (also referred to as a bending machine or a bending device, hereinafter) at a position which is as close as possible to a finish rolling mill. Besides, normally, on a rear surface side of the finish rolling mill, it is often the case that a guidance guide and cooling equipment (for example, water cooling equipment or the like) are generally arranged, and when installing the bending machine to the existing facility, remodeling of the facility is often required. Accordingly, in the bending machine, there is a large advantage for downsizing the equipment such as a drive unit (a motor) for driving rolls configuring a caliber.

However, in the technique as described in the aforementioned Patent Document 1, for example, it is required to install a drive unit which drives both of upper and lower rolls configuring a caliber of a bending machine, and thus there was a problem of increase in facility cost and increase in remodeling cost with respect to the existing facility.

In view of the above-described problems, an object of the present invention is to provide a bending device, a production facility for a steel sheet pile, a bending method, and a production method for a steel sheet pile with which, when performing bending on a material to be rolled after being subjected to hot rolling to produce a steel sheet pile product, a facility cost and a remodeling cost can be reduced, and further, a steel sheet pile product with high dimensional accuracy can be produced by suppressing occurrence of warpage of the material to be rolled during the bending.

Means for Solving the Problems

The present inventors conducted earnest studies for achieving the above-described object, and found out that, when producing a steel sheet pile product (a hat-shaped steel sheet pile, in particular) by performing bending on a material to be rolled after being subjected to hot rolling, even if only one roll out of upper and lower rolls configuring a caliber of a bending device is driven and the other roll is not driven, it is possible to perform bending (forming) in a direction of increasing a cross sectional height of the material to be rolled, without causing occurrence of warpage in the material to be rolled. In this case, downsizing of a configuration of a roll drive unit can be realized. Further, a device configuration of driving only one of rolls described above can be realized only by performing simple remodeling on the existing rolling facility or bending device, and thus a new facility investment or the like is not required, which is useful in terms of cost reduction and facility efficiency.

According to the present invention based on the above-described findings, there is provided a bending device which produces a steel sheet pile by performing bending on a material to be rolled after being subjected to rough rolling, intermediate rolling, and finish rolling in a hot state, in a direction of increasing a cross sectional height of the material to be rolled, the bending device including: a forming stand including a forming caliber configured by an upper caliber roll and a lower caliber roll; and a drive unit driving either the upper caliber roll or the lower caliber roll.

Effect of the Invention

According to the present invention, when performing bending on a material to be rolled after being subjected to hot rolling to produce a steel sheet pile product, a facility cost and a remodeling cost can be reduced, and further, it becomes possible to produce a steel sheet pile product with high dimensional accuracy by suppressing occurrence of warpage of the material to be rolled during the bending.

EMBODIMENTS FOR CARRYING OUT THE INVENTION

Figure 1:
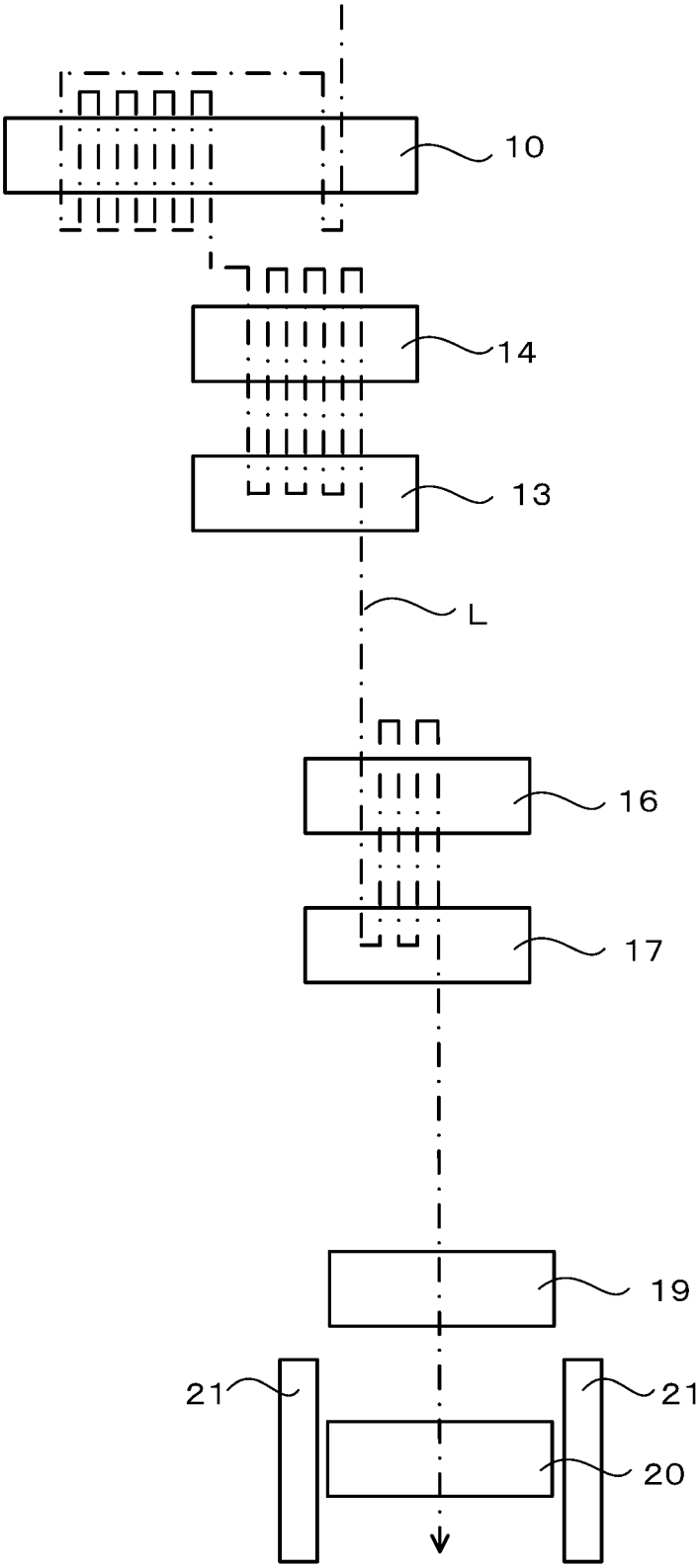
FIG. 1 is a schematic explanatory view illustrating a rolling line according to an embodiment of the present invention.

Hereinafter, embodiments of the present invention will be explained while referring to the drawings. Note that, in this description and the drawings, the same codes are given to components having substantially the same functional configurations to omit duplicated explanation. Note that in the present embodiment, explanation will be made on a case where a hat-shaped steel sheet pile is produced as a steel sheet pile product.

Configuration of Rolling Line

FIG. 1 is an explanatory view of a rolling line L (indicated by a dot and dash line in the drawing) for producing the hat-shaped steel sheet pile according to the embodiment of the present invention, and rolling mills provided on the rolling line L. Note that in FIG. 1, a rolling forward direction of the rolling line L is a direction indicated with an arrow mark, a material to be rolled flows in the direction, rolling and bending (forming) are performed in respective rolling mills and a bending device on the line to shape a product.

As illustrated in FIG. 1, on the rolling line L, a rough rolling mill 10, a first intermediate rolling mill 13, a second intermediate rolling mill 16, a finish rolling mill 19, and a bending device 20 are arranged in order from the upstream side. Here, an edger rolling mill 14 is arranged by being adjacent to the first intermediate rolling mill 13, and an edger rolling mill 17 is arranged by being adjacent to the second intermediate rolling mill 16. Further, in the vicinity of the bending device 20, pieces of cooling equipment 21 are provided along the rolling line L. Here, the cooling equipment 21 is, for example, equipment including a plurality of cooling sprays and the like which spray cooling water to the material to be rolled on the rolling line L from sides of the material to be rolled.

On the rolling line L, a rectangular material (material to be rolled) heated in a not-illustrated heating furnace is rolled in sequence in the rough rolling mill 10 to the finish rolling mill 19, and further formed in the bending device 20, to be a hat-shaped steel sheet pile being a final product. Note that hereinafter, for the sake of explanation, the material to be rolled rolled in the rough rolling mill 10 is also called a raw blank, the material to be rolled rolled in the first intermediate rolling mill 13 to the second intermediate rolling mill 16 is also called an intermediate material, and the material to be rolled rolled in the finish rolling mill 19 is also called a finished material 19*a*. Specifically, one obtained by forming (changing a cross section of) the finished material 19*a* by using the bending device 20, becomes the final product (namely, the hat-shaped steel sheet pile).

Here, the rough rolling mill 10, the first intermediate rolling mill 13, the second intermediate rolling mill 16, the finish rolling mill 19, and the edger rolling mills 14, 17 arranged in an accompanied manner, which are arranged on the rolling line L, are general pieces of equipment conventionally used in production of a steel sheet pile, so that explanation regarding detailed device configurations and so on thereof will be omitted in this description.

Configuration of Bending Device

Figure 2:
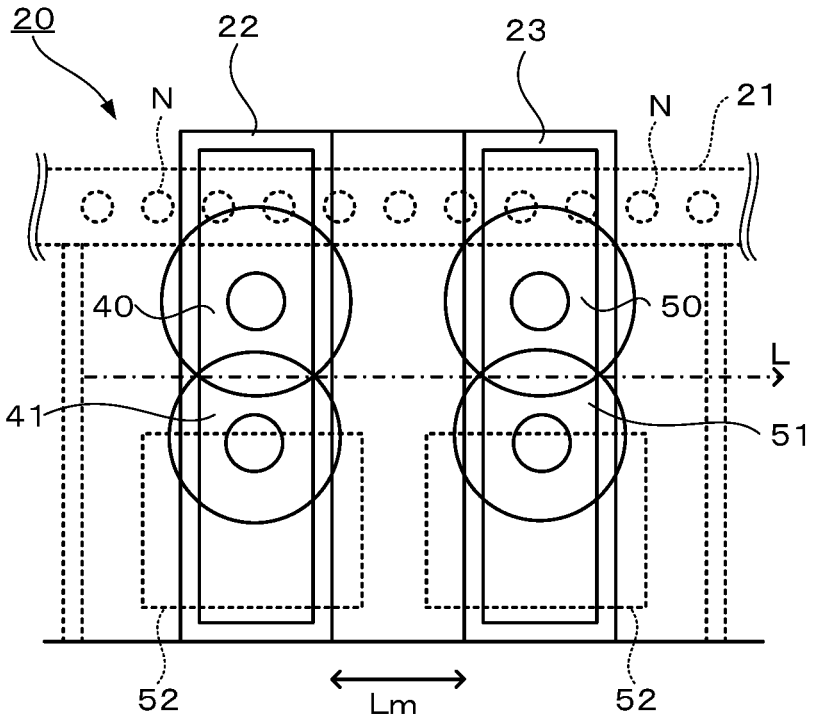
FIG. 2 is a schematic side sectional view of a bending device.
Figure 3:
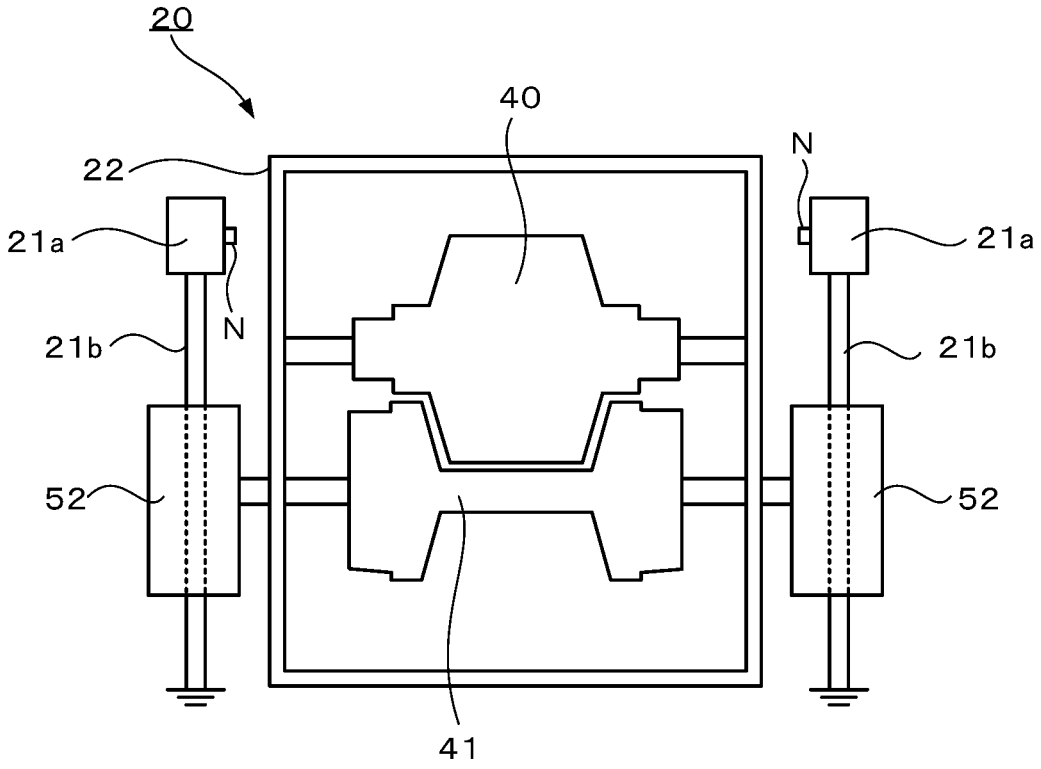
FIG. 3 is a schematic front view of the bending device.

Next, a detailed configuration of the bending device 20 will be described with reference to the drawings. FIG. 2 is a schematic side sectional view of the bending device 20, and FIG. 3 is a schematic front view of the bending device 20. The bending device 20 illustrated in FIG. 2 and FIG. 3 performs bending (bending forming) on the finished material 19*a* after being subjected to finish rolling in the finish rolling mill 19. Note that FIG. 3 is a schematic front view of a first stand 22 provided to the bending device 20 to be explained hereinbelow.

As illustrated in FIG. 2, the bending device 20 according to the present embodiment includes the two forming stands 22, 23 (also called an upstream-side first stand 22 and a downstream-side second stand 23, hereinafter) which are adjacently arranged in series. Further, these two stands are provided by being separated by a predetermined distance Lin. Further, as illustrated in FIG. 3, the respective stands 22, 23 are provided with forming calibers (calibers 44, 55 to be described later), respectively, each of which is configured by an upper caliber roll and a lower caliber roll, and a caliber shape in the first stand 22 and a caliber shape in the second stand 23 are different from each other.

Further, as illustrated in FIG. 2 and FIG. 3, on each of both side parts of the first stand 22 and the second stand 23, there is provided the cooling equipment 21 which sprays cooling water to perform cooling of the material to be rolled. This cooling equipment 21 is configured by a cooling part 21*a* including a plurality of cooling spray nozzles N, and a support part 21*b* which supports the cooling part 21*a*. The cooling part 21*a* is supported by the support part 21*b* on a side of an upper roll of the calibers 45, 55 to be described later, and is configured to spray the cooling water toward the material to be rolled passing through the respective stands 22, 23.

Caliber Configuration of Bending Device

Figure 4:
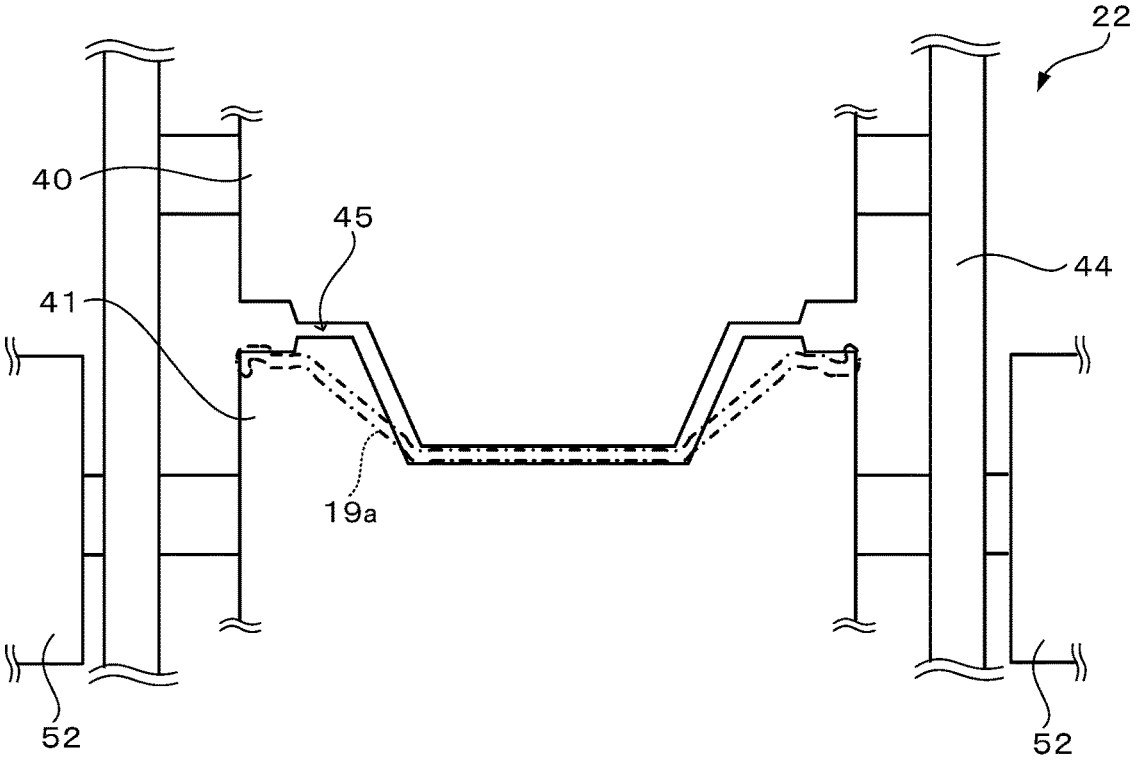
FIG. 4 is a schematic enlarged front view illustrating a caliber shape of a first stand.
Figure 5:
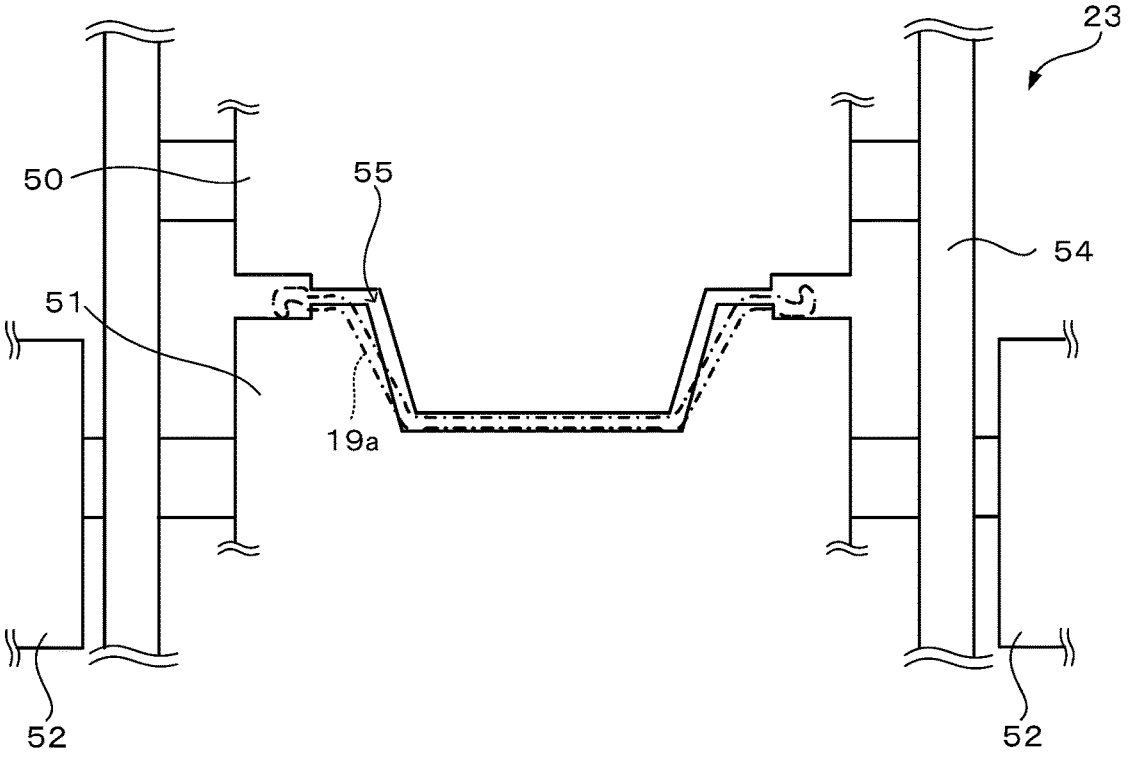
FIG. 5 is a schematic enlarged front view illustrating a caliber shape of a second stand.

Next, the roll configuration and the caliber shape of each of the first stand 22 and the second stand 23 will be explained. FIG. 4 is a schematic enlarged front view illustrating the caliber shape of the first stand 22, and FIG. 5 is a schematic enlarged front view illustrating the caliber shape of the second stand 23. Note that in FIG. 4 and FIG. 5, a shape of a cross section of the finished material 19*a* before being subjected to the forming by the bending device 20 is illustrated by a dot and dash line.

As illustrated in FIG. 3 and FIG. 4, in the first stand 22, an upper caliber roll 40 and a lower caliber roll 41 are provided by being supported by a casing 44, and the upper caliber roll 40 and the lower caliber roll 41 configure the caliber 45. The caliber 45 changes an angle made by a portion corresponding to a flange (namely, a flange corresponding part) of the finished material 19*a* and a portion corresponding to a web (namely, a web corresponding part) of the finished material 19*a*, to perform bending on the finished material 19*a* to have a predetermined shape of a height and a width. In particular, when the hat-shaped steel sheet pile is produced, a method is employed such that the material to be rolled (from the raw blank to the finished material 19*a*) is rolled at a height-reduced shape in the rough rolling mill 10 to the finish rolling mill 19, and the bending is performed in the bending device 20 to increase the height of the material to be rolled to a desired product height.

Further, as illustrated in FIG. 5, in the second stand 23, an upper caliber roll 50 and a lower caliber roll 51 are provided by being supported by a casing 54, and the upper caliber roll 50 and the lower caliber roll 51 configure the caliber 55.

Further, as illustrated in FIG. 2 to FIG. 5, a drive unit such as a motor is not installed to the upper caliber roll 40 of the first stand 22 and the upper caliber roll 50 of the second stand 23, and thus the upper caliber rolls 40 and 50 are not driven. On the other hand, to each of the lower caliber roll 41 of the first stand 22 and the lower caliber roll 51 of the second stand, a drive unit 52 such as a motor, for example, is installed, and the lower caliber roll 41 and the lower caliber roll 51 are configured to be rotated at a predetermined peripheral speed by the operation of the drive unit 52.

Forming in Bending

Figure 6:
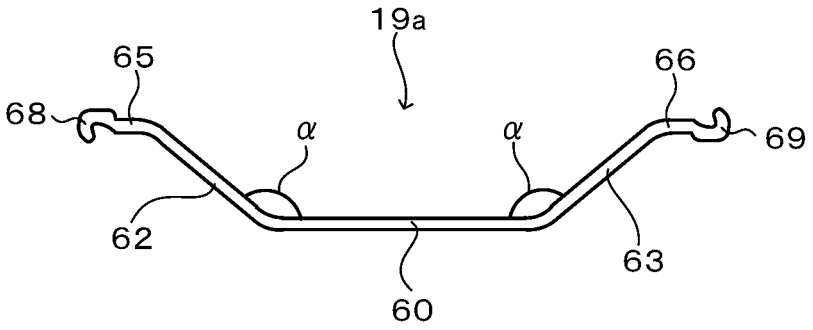
FIG. 6 are explanatory views regarding a shape change of a material to be rolled which is subjected to bending in the first stand and the second stand.
Figure 6:
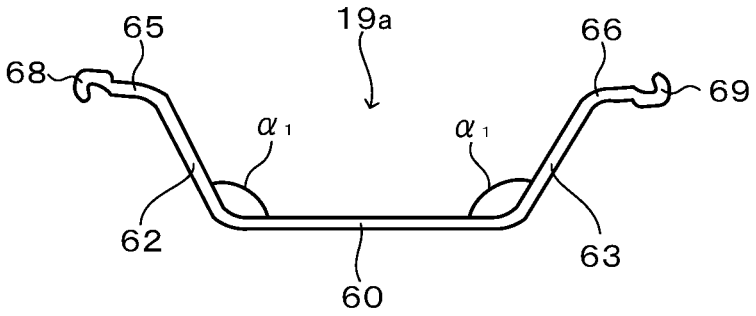
Figure 6:
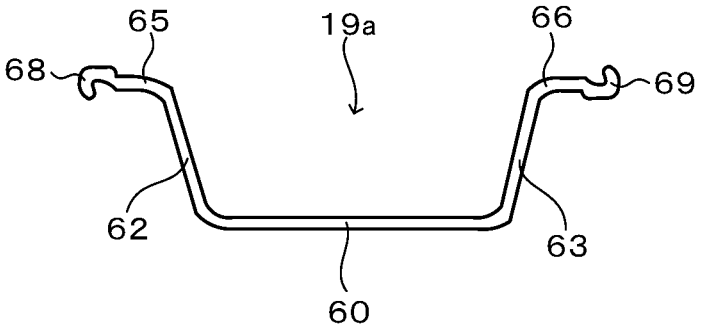

Subsequently, the forming of the material to be rolled in the stands 22, 23 described above will be explained. FIG. 6 are explanatory views regarding a shape change of the material to be rolled (the finished material 19*a*) which is subjected to the bending in the first stand 22 and the second stand 23, in which FIG. 6(*a*) is a schematic sectional view before performing working in the first stand 22, FIG. 6(*b*) is a schematic sectional view at a time of performing working in the first stand 22, and FIG. 6(*c*) is a schematic sectional view at a time of performing working in the second stand 23. As illustrated in FIG. 6(*a*), the finished material 19*a* has a substantially hat shape, and is composed of a substantially horizontal web corresponding part 60, flange corresponding parts 62, 63 connected to both ends of the web corresponding part 60 at a predetermined angle (indicated as an angle $\alpha$ in the drawing), arm corresponding parts 65, 66 connected to end parts of the flange corresponding parts 62, 63 different from the sides thereof connected with the web corresponding part, and joint corresponding parts 68, 69 connected at tips of the arm corresponding parts 65, 66.

The finished material 19*a* illustrated in FIG. 6(*a*) is subjected to bending so that the angle a made by the web corresponding part 60 and each of the flange corresponding parts 62, 63 becomes small (the angle $\alpha$ becomes an angle al illustrated in FIG. 6(*b*)) in the caliber 45 of the first stand 22.

Next, as illustrated in FIG. 6(*c*), bending is performed in the caliber 55 of the second stand 23, whereby a hat-shaped steel sheet pile being a product is produced. Note that although the explanation has been made on the forming performed by the respective calibers 45, 55 with reference to FIG. 6(*b*) and FIG. 6(*c*), these processes of bending are continuously performed on one sheet of material to be rolled (finished material 19*a*), and normally, the forming is performed in a state where one sheet of material to be rolled is passed simultaneously through both the first stand 22 and the second stand 23.

Roll Driving in Bending

As described above, in the bending device 20 according to the present embodiment, the upper caliber rolls (the upper caliber rolls 40, 50) of both stands (the first stand 22 and the second stand 23) are not driven. Accordingly, there is no need to attach the drive unit such as a motor to the upper caliber rolls 40, 50, and it becomes possible to arrange the cooling equipment 21 to the vicinity of the stand (in the vicinity of the upper roll), as illustrated in FIG. 3. Therefore, it is possible to perform bending at high cooling efficiency. Besides, since it is possible to obtain the bending device 20 through simple remodeling such that the drive unit which drives the upper roll of the rolling stand is removed from the existing rolling facility, the facility cost can be reduced.

On the other hand, in the bending device 20, it is configured that the upper caliber rolls 40, 50 are not driven and the lower caliber rolls 41, 51 are driven in the first stand 22 and the second stand 23, so that there is a possibility that upward warpage occurs in the material to be rolled (the finished material 19*a*) passed through the bending device 20, due to the driving of the lower caliber rolls 41, 51. Accordingly, the present inventors conducted earnest studies regarding the presence/absence of upward warpage that occurs when performing bending of the hat-shaped steel sheet pile in the bending device 20 according to the present embodiment.

Figure 7:
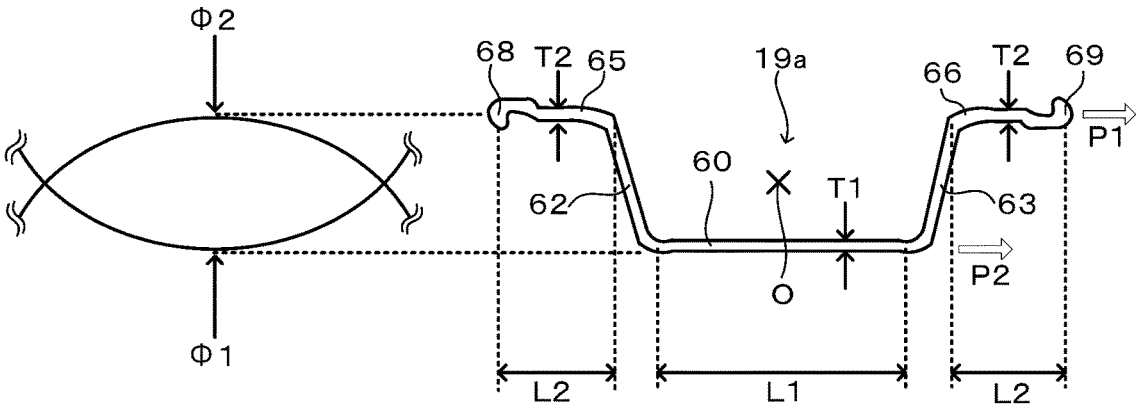
FIG. 7 is an explanatory view regarding a finished material having a substantially hat shape.

FIG. 7 is an explanatory view regarding the finished material 19*a* having a substantially hat shape (namely, a substantially product shape), and illustrates, for the sake of explanation, the upper and lower caliber rolls of the forming stand (the upper and lower caliber rolls in the first stand 22 or the second stand 23) and the finished material 19*a* by arranging them side by side so that they correspond to each other. Note that codes regarding the respective portions of the finished material 19*a* in FIG. 7 are the same as those in FIG. 6. As illustrated in FIG. 7, the shape of the finished material 19*a* is substantially a hat shape which is left-right symmetric except for the joint corresponding parts 68, 69, and a horizontal direction length L1 of the web corresponding part 60 and a total of horizontal direction lengths L2 of the arm corresponding parts 65, 66 are substantially equal (namely, L1 ≒ L2+L2). Further, the bending is performed in a state where a position of a center of gravity O of the finished material 19*a* and a roll center position of the first stand 22 and the second stand 23 substantially match. Further, a sheet thickness T1 of the web corresponding part 60 and a sheet thickness T2 of each of the arm corresponding parts 65, 66 are substantially equal (namely, T1 ≒ T2).

Generally, the warpage of the material to be rolled in the bending is caused by elongation of a worked cross section in the longitudinal direction, or a peripheral speed difference between the material to be rolled and the rolls. Since the reduction is not performed almost at all in the bending of the hat-shaped steel sheet pile in the invention of the present application, it is clear that the elongation of the worked cross section in the longitudinal direction does not occur almost at all. Specifically, the peripheral speed difference between the material to be rolled and the rolls is the cause of the occurrence of warpage.

When a product to be produced is the hat-shaped steel sheet pile, L1 ≒ L2+L2, and T1 ≒ T2 are satisfied as described above, so that by designing Φ1 (a diameter of an upper caliber roll) and Φ2 (a diameter of a lower caliber roll) being roll peripheral speeds of the upper and lower caliber rolls to be substantially equal (namely, Φ1 ≒ Φ2), force P1 applied to an upper part of the material to be rolled and force P2 applied to a lower part of the material to be rolled become equal and thus the forces in the upper and lower directions are balanced, resulting in that the warpage does not occur.

Operation and Effect

As described above, when producing the hat-shaped steel sheet pile product, in particular, through the bending, regarding the configuration of the respective caliber rolls in the first stand 22 and the second stand 23, even if the upper caliber rolls 40, 50 are not driven and only the lower caliber rolls 41, 51 are driven, the bending can be performed without causing upward warpage in the finished material 19*a*. Further, as described above, since there is no need to attach the drive unit such as the motor to the upper caliber rolls 40, 50, it becomes possible to downsize the facility and reduce the cost.

Namely, with the use of the bending device 20 according to the present embodiment, the facility can be downsized, and only by performing simple remodeling on the existing facility, it is possible to install the bending device 20 according to the present embodiment, resulting in that a large reduction in facility cost can be realized.

One example of the embodiment of the present invention has been explained above, but the present invention is not limited to the illustrated embodiment. It should be understood that various changes and modifications are readily apparent to those skilled in the art within the scope of the spirit as set forth in claims, and those should also be covered by the technical scope of the present invention.

For example, in the above-described embodiment, the case has been explained in which the bending device 20 is provided with the two stands of the first stand 22 and the second stand 23, but the present invention is not limited to this. Specifically, the bending device is only required to be provided with a single stand or a plurality of stands which are arranged in series. Further, when the bending of the material to be rolled is performed by using a plurality of stands of three or more, it becomes possible to perform forming more effectively and with higher accuracy in accordance with the increase in the number of stands, so that it is possible to efficiently produce a product of a desired shape.

Further, in the above-described embodiment, the case of producing the hat-shaped steel sheet pile as the steel sheet pile product is cited as an example, and the case of performing the rolling and the bending on the hat-shaped steel sheet pile in a U-posture (a posture of protruding downward) is illustrated and explained. In this case, it is only required to configure such that the upper caliber rolls are not driven and only the lower caliber rolls are driven, as described above. However, depending on rolling facilities, there is also a case where the hat-shaped steel sheet pile is subjected to the rolling and the bending in an inverted U-posture (a posture of protruding upward). In this case, it is only required to configure the device in which only the upper caliber rolls are driven and the lower caliber rolls are not drive, in a manner opposite to that of the above-described embodiment.

First Other Embodiment of Present Invention

Further, in the above-described embodiment, the case of producing the hat-shaped steel sheet pile as the steel sheet pile product has been explained as an example, but the present invention is not limited to this, and the present invention can be applied to various steel sheet pile products such as a U-shaped steel sheet pile, for example. However, when producing the hat-shaped steel sheet pile product through the bending, the upward warpage of the material to be rolled (the finished material) during the bending can be avoided since the horizontal direction length of the web corresponding part and the total of the horizontal direction lengths of the arm corresponding parts are substantially equal as described in the aforementioned embodiment, but when producing another steel sheet pile product, the horizontal direction length of the web corresponding part and the total of the horizontal direction lengths of the arm corresponding parts are not always equal. Accordingly, the present inventors further conducted earnest studies regarding the technique of avoiding the upward warpage of the material to be rolled during the bending. Hereinafter, the technique will be described.

Figure 8:
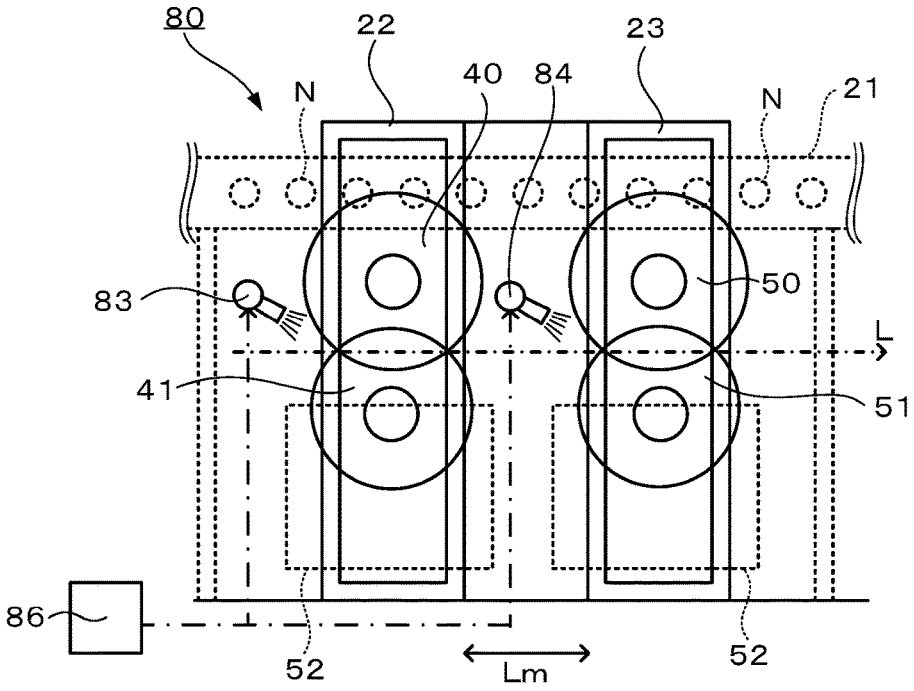
FIG. 8 is a schematic side sectional view of a bending device according to a first other embodiment of the present invention.

FIG. 8 is a schematic side sectional view of a bending device 80 according to the first other embodiment of the present invention. Note that a configuration of the bending device 80 is the same as the above-described embodiment except for a point that lubricating oil supply mechanisms 83, 84 to be described later are provided, so that the same codes are given to components having substantially the same functional configurations to omit explanation thereof.

As illustrated in FIG. 8, in the bending device 80, the lubricating oil supply mechanisms 83, 84 which supply the lubricating oil being a caliber oil, for example, to the upper caliber rolls 40, 50, are provided on an inlet side of the first stand 22 and an inlet side of the second stand 23, respectively. Further, there is provided a control unit 86 which controls an amount of the lubricating oil to be supplied from these lubricating oil supply mechanisms 83, 84 to the upper caliber rolls 40, 50.

When performing bending of the material to be rolled in the bending device 80 illustrated in FIG. 8, a predetermined amount of lubricating oil is supplied to the not-driven upper caliber rolls 40, 50 in the first stand 22 and the second stand 23, respectively. For this reason, a friction coefficient between the material to be rolled, and the respective upper caliber rolls 40, 50 is reduced, and even if the sheet is passed in a state where the lower caliber rolls 41, 51 are driven, the upward warpage of the material to be rolled can be avoided. Note that the amount of lubricating oil to be supplied may be appropriately determined to a suitable amount, and it may also be determined by referring to, for example, past result data of bending.

Figure 9:
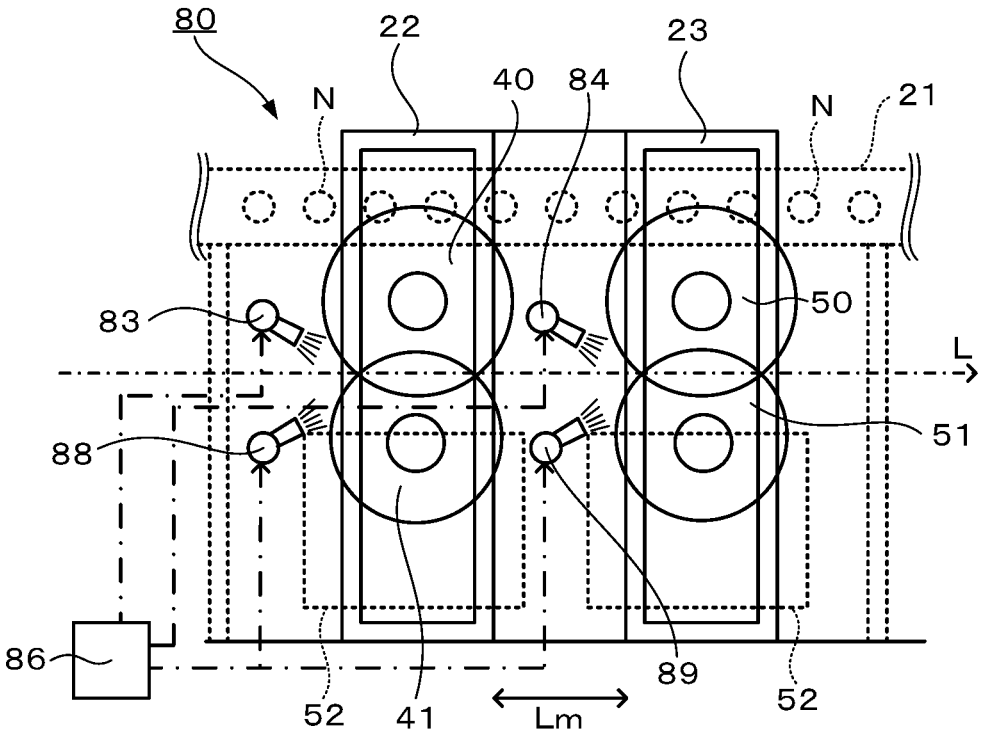
FIG. 9 is a schematic side sectional view of a bending device according to the first other embodiment of the present invention.

Further, in the bending device 80 explained with reference to FIG. 8, the lubricating oil is supplied to the upper caliber rolls 40, 50 by the lubricating oil supply mechanisms 83, 84, and besides, it is also possible to configure such that the lubricating oil is supplied also to the lower caliber rolls 41, 51. FIG. 9 is a schematic side sectional view of the bending device 80 with such a configuration. As illustrated in FIG. 9, it is also possible to provide lubricating oil supply mechanisms 88, 89, respectively, which supply the lubricating oil to the lower caliber rolls 41, 51, in addition to the lubricating oil supply mechanisms 83, 84 illustrated in FIG. 8. In this case, the control unit 86 preferably controls a supply amount of the lubricating oil to be supplied by the lubricating oil supply mechanisms 88, 89.

Figure 10:
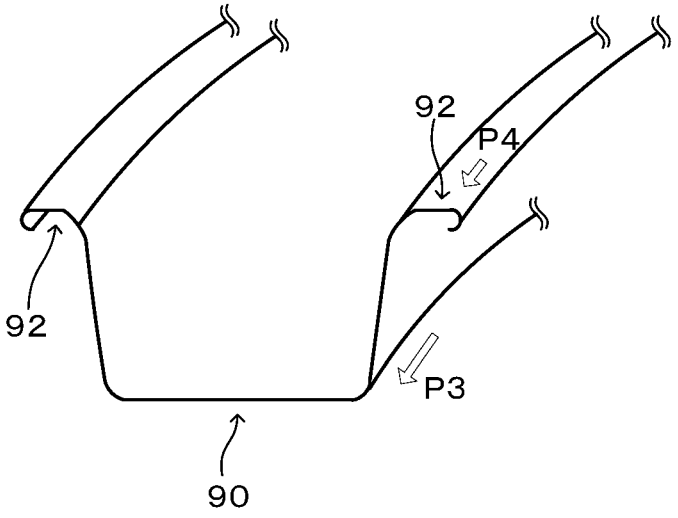
FIG. 10 is an explanatory view regarding bending of a U-shaped steel sheet pile.

Here, the control unit 86 can preferably control a ratio between the supply amount of lubricating oil to be supplied by the lubricating oil supply mechanisms 83, 84 and the supply amount of lubricating oil to be supplied by the lubricating oil supply mechanisms 88, 89. As an example, when a U-shaped steel sheet pile is produced through bending in a U-posture (a posture of protruding downward), as illustrated in FIG. 10, rolling direction force P3 is applied to a web corresponding part 90 of the material to be rolled by the bending, and on the other hand, to a claw part 92 of the material to be rolled, force P4 of canceling the rolling direction force P3 is generated. However, in the material to be rolled having the shape of the U-shaped steel sheet pile, a length of the claw part 92 is shorter (smaller) than a length of the web corresponding part 90, so that the force P4 is smaller than the rolling direction force P3, resulting in that the upward warpage of the material to be rolled occurs in the bending. Therefore, in such a case, in order to make a friction coefficient between the material to be rolled and an upper caliber roll, and a friction coefficient between the material to be rolled and a lower caliber roll to be different values, by supplying the lubricating oil only to an upper surface (on the upper caliber roll side) of the material to be rolled, the occurrence of upward warpage can be suppressed.

Second Other Embodiment of Present Invention

Figure 11:
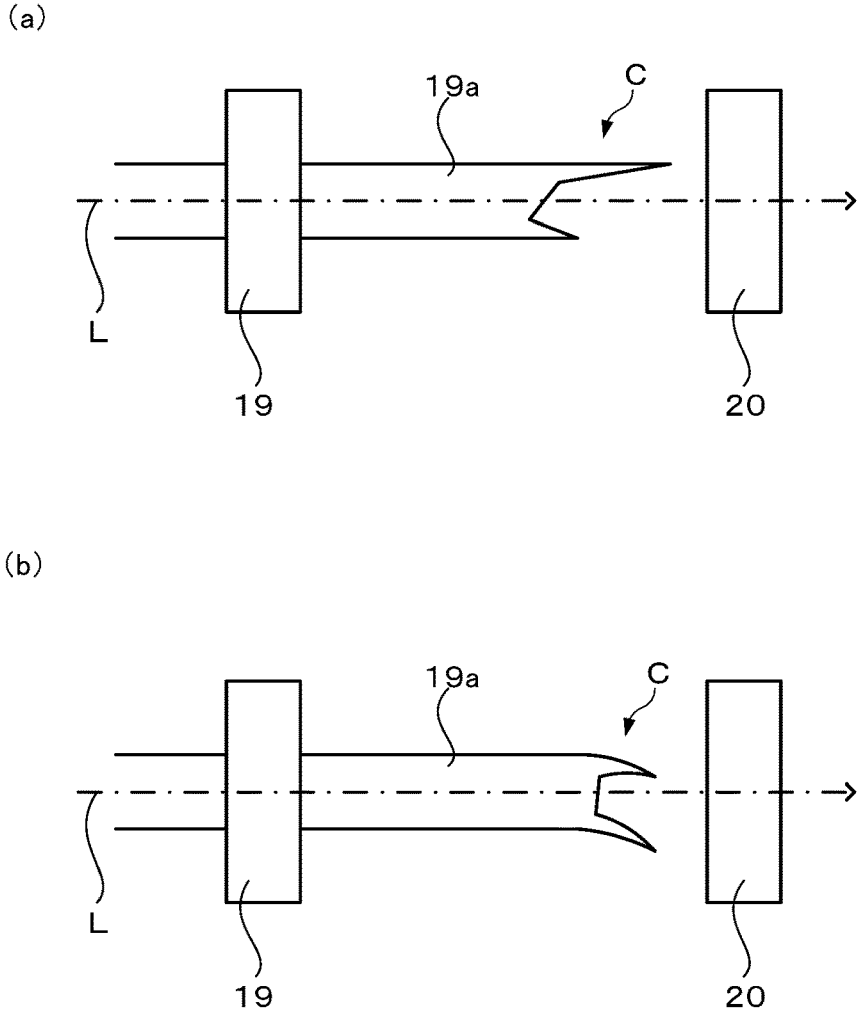
FIG. 11 are schematic explanatory views illustrating a state where a left-right asymmetric crop part is formed on a material to be rolled.

Further, in the production process of the hat-shaped steel sheet pile product using the bending forming, it is known that in the hot rolling step, a left-right asymmetric crop part is likely to be formed at a tip of the material to be rolled, due to a displacement in the left-right direction in a frontal view of a rolling state. When the material to be rolled (the finished material 19*a*) with such a crop part formed thereon is tried to be formed as it is in the bending device 20, displaced biting (displacement of biting) is likely to occur in the bending device 20. FIG. 11 are schematic explanatory views illustrating a state where a left-right asymmetric crop part C is formed on the material to be rolled (the finished material 19*a*).

As illustrated in FIG. 11(*a*) and FIG. 11(*b*), when the left-right asymmetric crop part C is formed at the tip of the finished material 19*a*, a preceding flange is bitten precedently in the bending device 20, and the biting is not performed uniformly. Consequently, centering of the finished material 19*a* is not performed accurately in the bending device 20, which causes a material passage failure and defective product shape in accordance with the material passage failure. In particular, as illustrated in FIG. 11(*b*), when the crop part C of the finished material 19*a* is formed by being bent in a width direction, there is a large possibility that the finished material 19*a* gets stuck with a guide (not illustrated) which is provided to the bending device 20 and guides the biting of the finished material 19*a*, resulting in the material passage failure.

Accordingly, the present inventors conducted earnest studies regarding a relation between a displacement amount in the width direction when biting the finished material 19*a* in the bending device 20 and a forming angle, and found out that, when the displaced biting occurs in the bending device 20, namely, when the displacement amount becomes large, the material passage failure does not occur by setting a relation between an inclination angle of a flange corresponding part before bending and a forming angle in the caliber 45 to a predetermined relation. This finding will be explained hereinafter with reference to the drawings. Note that the aforementioned displacement amount corresponds to a displacement between connection parts (also described as corner parts, hereinafter) between the web corresponding part 60 and the flange corresponding parts 62, 63 of the finished material 19*a*, and corner parts of the caliber 45 corresponding to those connection parts, the displacement being expressed by a horizontal direction length.

Figure 12:
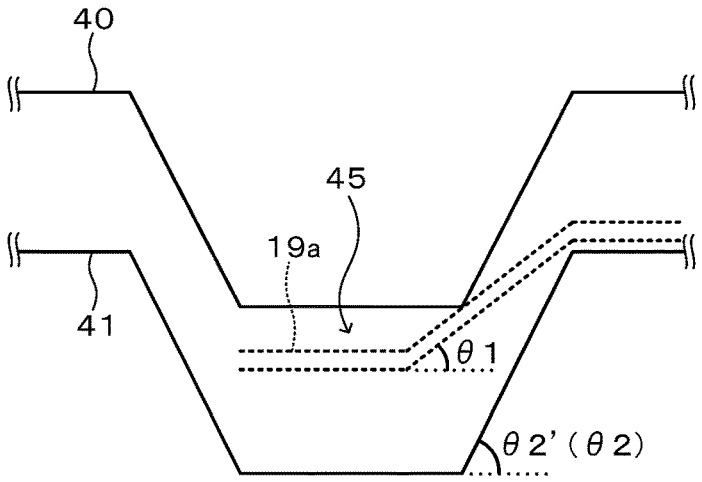
FIG. 12 is a schematic sectional view illustrating a state where a tip part of a finished material is bitten by a bending forming machine in a state of being fully displaced in a width direction.

FIG. 12 is a schematic sectional view illustrating a state where a tip part of the finished material 19*a* is bitten by the bending device 20 (namely, the caliber 45 of the first stand 22) in a state of being fully displaced in the width direction. The finished material 19*a* may be fully displaced up to a position where a part at which either of the flange corresponding parts and the arm corresponding part are connected in the finished material 19*a* and that in the caliber 45 or 55 match. In this case, a state in which the flange on the right side (the upper side in FIG. 11(*a*) and FIG. 11(*b*)) is precedently bitten by the bending device 20 is expressed. Here, for the sake of explanation, an inclination angle of the flange corresponding part of the finished material 19*a* before forming with respect to the horizontal direction (also described simply as a flange angle, hereinafter) is set to $\theta 1$, and an angle of an inclined part of the caliber 45 (a place corresponding to the flange corresponding part in the caliber 45) with respect to the horizontal direction is set to $\theta 2$, as illustrated in FIG. 12. A difference between the angles $\theta 1$ and $\theta 2$ (namely, $\theta 2$-$\theta 1$) becomes a forming angle $\Delta\theta$ in the caliber 45. Note that strictly speaking, the angle of the inclined part of the caliber 45 projected onto a vertical plane at a position where one flange is bitten between upper and lower rolls illustrated in FIG. 12 becomes $\theta 2'$, but is represented by the aforementioned $\theta 2$ in this case.

Further, as described in the aforementioned embodiment, in the bending device 20, it is sometimes configured such that one caliber roll (the upper caliber roll 40, 50, for example) is not driven and only the other caliber roll (the lower caliber roll 41, 51, for example) is driven to perform bending. According to the verification conducted by the present inventors, it was found out that when the caliber roll of the bending device 20 is set to be driven based on a single-drive system, it is possible to perform the bending without causing the warpage as described above, but deterioration of biting property is concerned. For example, when performing rolling and bending on a hat-shaped steel sheet pile in a so-called inverted U-posture (a posture of protruding upward), a caliber roll which is first brought into contact with the material to be rolled, is a lower caliber roll. In that case, when the lower caliber roll is not driven, since no driving force is provided, the deterioration of biting property is concerned.

In particular, in a state where a crop part is formed at the tip of the material to be rolled, an influence with respect to the biting property is different between a case where both the upper and lower caliber rolls are driven and a case where one of the upper and lower caliber rolls is driven, as listed in Table 1 below. The crop part is an unsteady part and is freely deformed, so that it is difficult to be shaped in a left-right asymmetric manner. This is because, in an actual operation, the shaping in a left-right asymmetric manner is inevitably performed due to temperature unevenness due to heating, a set-up accuracy of rolls, elastic deflection of rolls, and the like.

TABLE 1

| | BOTH-DRIVING | SINGLE-DRIVING |
|---|---|---|
| PRESENCE OF CROP | Δ | X |
| ABSENCE OF CROP | ○ | ○ |

When the bending is performed on the material to be rolled in a state of having the left-right asymmetric crop part formed thereon, the contact with respect to the caliber rolls is started from a left or right preceding part of the material to be rolled. In this case, without depending on the roll driving system, the first bitten part is gripped by the rolls, and shifts under total cross section reduction while maintaining that position. For this reason, when the first bitten part is displaced, the displacement is unlikely to be corrected to the proper position (a left-right symmetric position), which leads to left-right unbalanced deformation. Specifically, as listed in Table 1, when the crop part is formed, the deterioration of biting property (x in Table) is observed in the single-driving, and even in the both-driving, a left-right dimensional difference is generated (Δ in Table).

Figure 13:
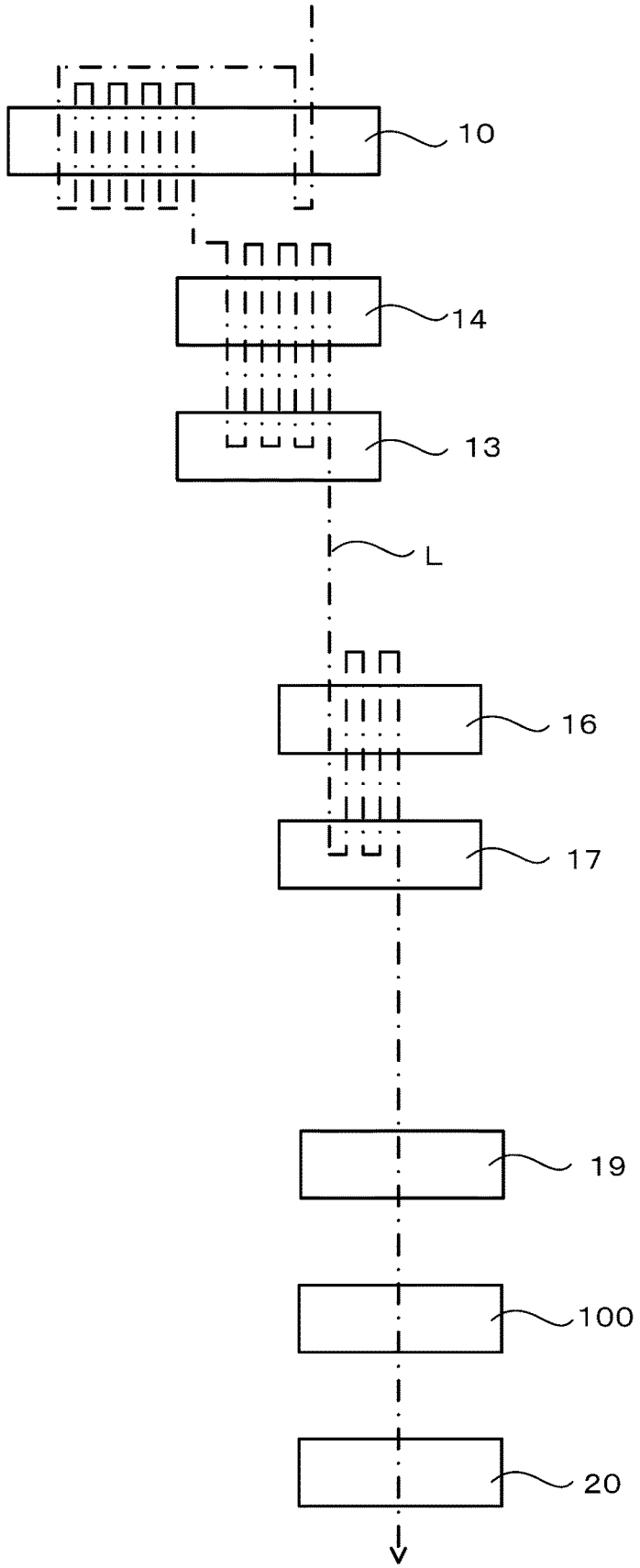
FIG. 13 is a schematic explanatory view of a rolling line which introduces a crop cutting machine.

In view of such circumstances, the present inventors invented a configuration of introducing a device of cutting the crop part, on the rolling line L explained in the above-described embodiment. FIG. 13 is a schematic explanatory view of a rolling line according to a second other embodiment of the present invention which introduces a crop cutting machine 100. As illustrated in FIG. 13, on the rolling line L, the rough rolling mill 10, the first intermediate rolling mill 13, the second intermediate rolling mill 16, the finish rolling mill 19, the crop cutting machine 100, and the bending device 20 are arranged in order from the upstream side. The finish rolling mill 19, the crop cutting machine 100, and the bending device 20 are arranged on a straight line. Further, the edger rolling mill 14 is arranged by being adjacent to the first intermediate rolling mill 13, and the edger rolling mill 17 is arranged by being adjacent to the second intermediate rolling mill 16.

Figure 14:
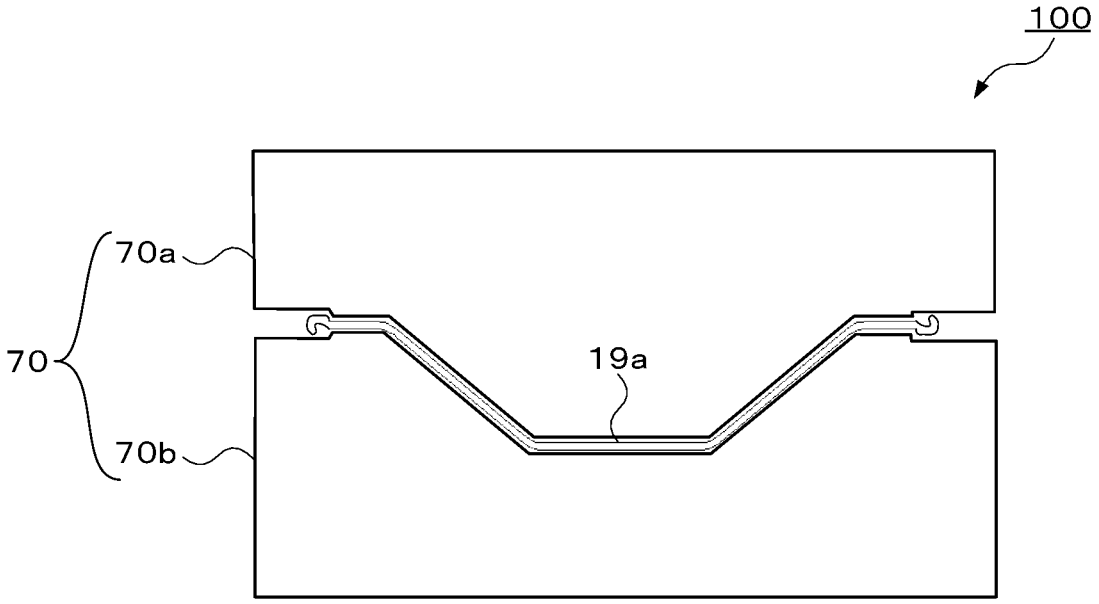
FIG. 14 is a schematic front view illustrating a restraining die of the crop cutting machine.

As illustrated in FIG. 14, the crop cutting machine 100 includes a restraining die 70 which restrains the finished material 19*a* from above and below, and the restraining die 70 includes an upper restraining die 70*a* which restrains an upper surface of the finished material 19*a*, and a lower restraining die 70*b* which restrains a lower surface of the finished material 19*a*. These upper restraining die 70*a* and lower restraining die 70*b* are respectively configured to be able to move in the upper direction and the lower direction. Further, since it is preferable to cut the crop part C in a short period of time at a position between the finish rolling mill 19 and the bending device 20, the crop cutting machine 100 is preferably one of shear type. As one example of such a shear, there can be cited a guillotine-type shear including an upper blade.

Figure 15:
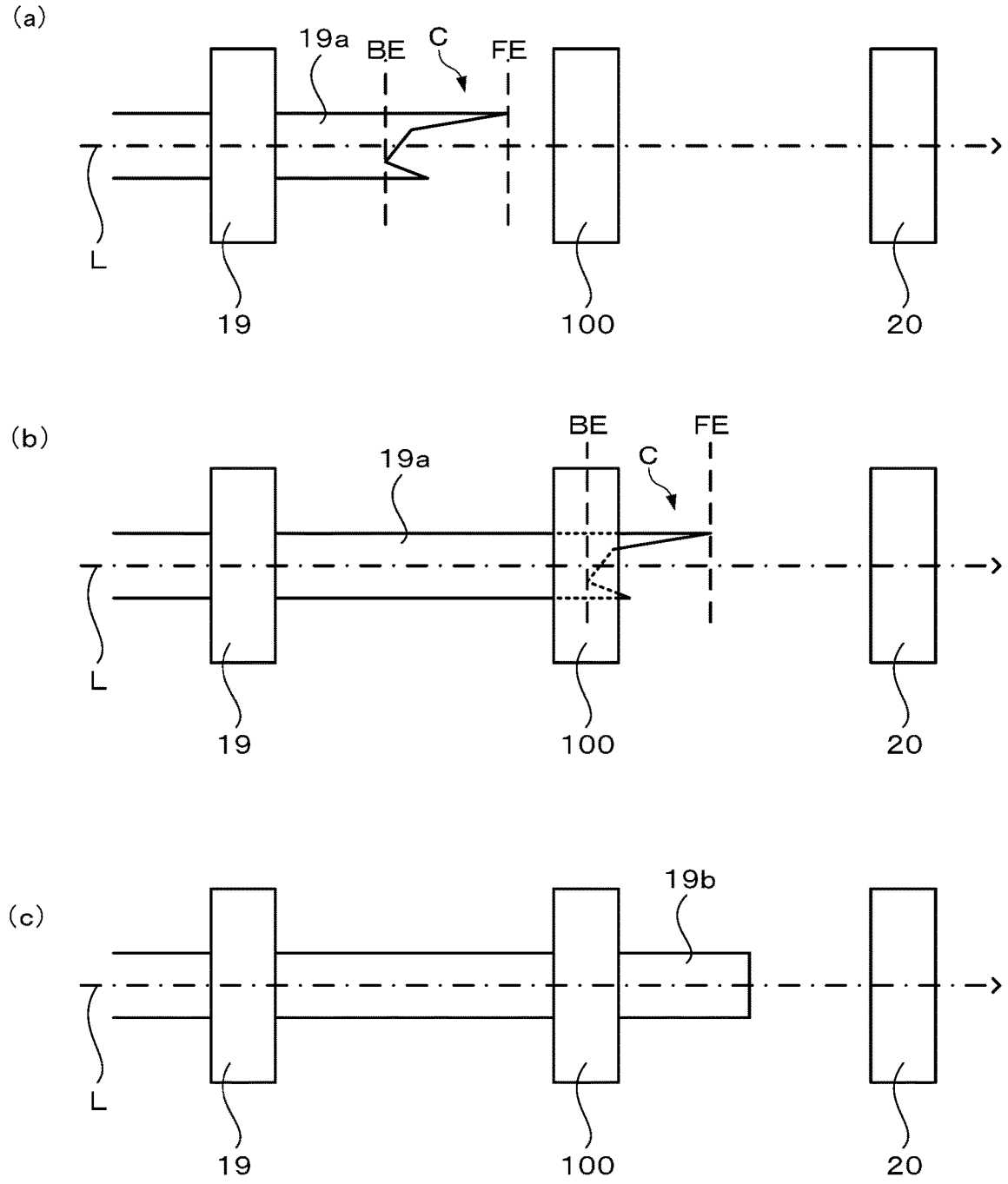
FIG. 15 are schematic explanatory views illustrating a crop cutting step.

Next, a cutting step of the crop part C at the tip of the finished material 19*a* using the crop cutting machine 100 will be explained. As illustrated in FIG. 15(*a*), at the tip of the finished material 19*a* after passing through the finish rolling mill 19, the left-right asymmetric crop part C is formed due to the asymmetry of the product shape, the temperature deviation, the displacement in the left-right direction of the rolling state, and the like. In this case, by a shape measurement sensor (not illustrated) or the like provided on the outlet side of the finish rolling mill 19, for example, a length from a foremost end position FE to a rearmost end position BE of the crop part C (described as an "entire crop length", hereinafter), a difference in left and right crop lengths, and a bending amount of the crop part C in the sheet width direction, are measured. These pieces of measurement information are transmitted to the crop cutting machine 100.

After that, the finished material 19*a* reaches the crop cutting machine 100, and in the crop cutting machine 100, the foremost end position FE of the crop part C of the finished material 19*a* is detected. At this time, based on the entire crop length information transmitted from the finish rolling mill 19, a line speed, and the like, a timing at which the rearmost end position BE of the crop part of the finished material 19*a* reaches right below an upper blade (not illustrated) provided to the crop cutting machine 100, is calculated. Further, as illustrated in FIG. 15(*b*), at the timing at which the rearmost end position BE of the crop part reaches right below the upper blade (not illustrated), the finished material 19*a* is restrained by the restraining die 70 of the crop cutting machine 100.

Subsequently, the upper blade (not illustrated) is lowered, and the crop part C of the finished material 19*a* is cut (hereinafter, the finished material 19*a* after cutting the crop part C therefrom, is referred to as a "finished material 19*b*"). Thereafter, the restraint of the finished material 19*b* by the restraining die 70 is released, and as illustrated in FIG. 15(*c*), the finished material 19*b* moves toward the bending device 20, and is bitten by the bending device 20 under application of pressing force by the finish rolling mill 19. Consequently, the finished material 19*b* is subjected to bending forming.

As described above, by performing the bending forming on the finished material after cutting the crop part C therefrom, even when the forming angle Δθ is large, the finished material can be bitten by the bending device with no problems, and the stable passage of material can be realized. This makes it possible to prevent the defective product shape, and to improve the productivity and the yield.

Note that depending on the shape of the crop part C formed at the tip of the finished material 19*a*, there is also a case where the performance of bending forming without cutting the crop part C, does not lead to the defective product shape. Accordingly, when the entire length of the crop formed at the tip of the finished material 19*a*, the difference in left and right crop lengths, the bending amount of the crop part C in the sheet width direction, and the like are predetermined amounts or less, the cutting of the crop part C by the crop cutting machine may not be performed. This makes it possible to save the time taken for cutting the crop part C, resulting in that the productivity can be improved. Note that the "predetermined amount" is appropriately changed according to the shape of the finished material, the bending device to be used, and the like.

The forming conditions explained here are suitable particularly in a case where a thickness of the corner part of the finished material 19*a* is 10 mm or more, for example.

Further, as the crop cutting machine, it is possible to use a fixed one or a mobile crop cutting machine capable of moving along the rolling line L direction. When cutting the crop part at the tip after the finish rolling, the cutting processing is preferably performed without stopping the finish rolling, so that if the mobile crop cutting machine which is synchronized with a transferring speed of the material to be rolled is used, it becomes also possible to perform the crop cutting without greatly reducing the line speed, resulting in that the stable material passage can be performed, and at the same time, the productivity can also be improved.

Figure 16:
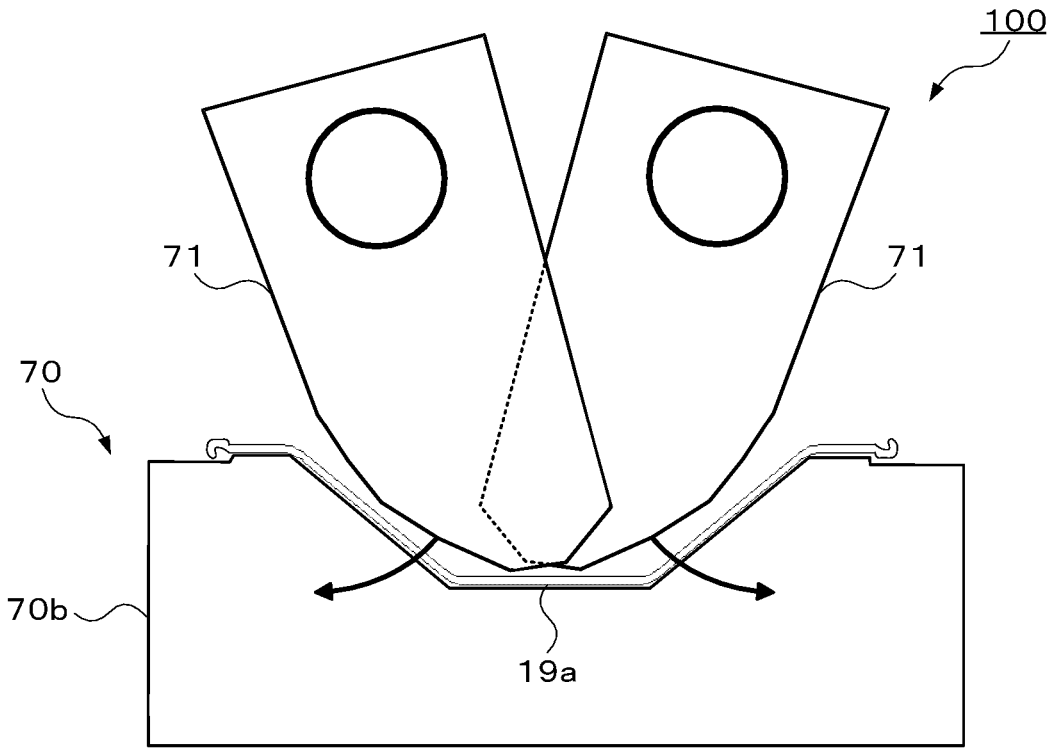
FIG. 16 is a schematic front view of a rotary shear.

Further, in this embodiment, the guillotine-type shear has been exemplified as the crop cutting machine, and it is also possible to use a rotary shear as illustrated in FIG. 16, for example. The rotary shear includes, for example, two shearing blades 71 arranged in order along the rolling line L direction. The respective shearing blades 71 are pivotally supported in an independent manner, respectively, and are configured in a rotatable manner, respectively. Further, when using the rotary shear, the restraining die 70 is not provided with the upper restraining die 70*a*, and the lower surface of the finished material 19*a* is restrained (supported) only by the lower restraining die 70*b*. By rotating the respective shearing blades 71 of the rotary shear configured as above, it is possible to cut the flange which protrudes as the crop part C. In a case of the hat-shaped steel sheet pile, as illustrated in FIG. 15, the crop part C of the finished material 19*a* is likely to be formed at both end parts in the width direction, and the part is a part corresponding to a flange of the finished material 19*a*, so that even in a case of using the rotary shear which cuts only the flange, it is possible to sufficiently cut the crop part C. Note that the upper restraining die 70*a* may also be provided.

As described above, the method and the equipment of cutting the crop part at the tip of the material to be rolled before performing the bending forming of the material to be rolled, regardless of the concrete device configuration of the crop cutting machine of the fixed type, the mobile type, the guillotine type, the rotary type, and the like, belong to the technical scope of the present invention.

Further, the cutting of the crop part is not limited to be performed between the finish rolling step and the bending forming step, and it may be performed during a period from the middle of the intermediate rolling step close to the finish rolling step to the start of the bending forming step. When the crop cutting is performed during the intermediate rolling step, there is also a possibility that a crop is formed again on the material to be rolled by the rest of the intermediate rolling step after performing the crop cutting, but a length of the formed crop is shorter than a length of the crop of the material to be rolled in a case where the cutting of crop is not performed. Accordingly, the crop which is formed again by the rest of the intermediate rolling step, is not large enough to impair the stability of material passage with respect to the bending device.

However, when there are a plurality of intermediate rolling mills in a case of performing crop cutting during the intermediate rolling step, the crop cutting may be performed in front of or behind any of the rolling mills, but since the sheet thickness of the material to be rolled is large in a first-half step of the intermediate rolling step, even if the crop part is formed on the material to be rolled, it is sometimes impossible to cut the crop part by the crop cutting machine in a short period of time. Therefore, the cutting of the crop part in the middle of the intermediate rolling step, is required to be performed after the material to be rolled is rolled to a sheet thickness at which the crop part can be cut by the cutting machine.

Further, when a plurality of intermediate rolling mills are provided, the crop cutting machine may be provided between a first intermediate rolling mill and a second intermediate rolling mill, and in that case, it is required to arrange the crop cutting machine on a downstream side of the intermediate rolling mill by which the material to be rolled is rolled to the sheet thickness at which the crop part can be cut. It is also possible, as a matter of course, that the rolling is performed by the second intermediate rolling mill, and then the crop cutting is performed before the finish rolling.

Further, the number of crop cutting machine provided on the rolling line L is not limited to one, and a plurality of crop cutting machines may also be provided. If the plurality of crop cutting machines are provided, the crop part of the material to be rolled can be surely cut, and the material passage with respect to the bending device can be further stabilized. Specifically, the cutting of the crop part may be performed a plurality of times during a period from the middle of the intermediate rolling step to the start of the bending forming step.

EXAMPLES

Figure 17:
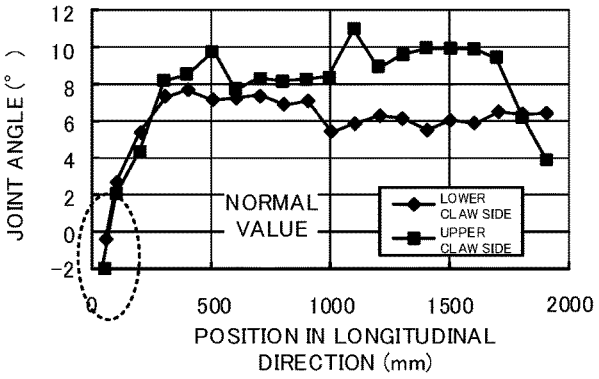
FIG. 17 is a graph illustrating a dimensional change in a longitudinal direction of left and right joint angles when performing bending forming on a material to be rolled formed with a crop part based on a single-drive system.
Figure 18:
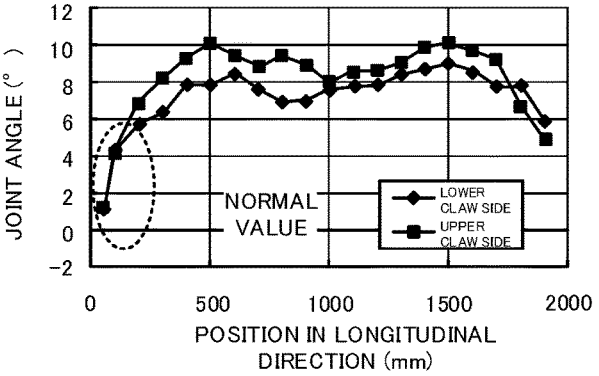
FIG. 18 is a graph illustrating a dimensional change in a longitudinal direction of left and right joint angles when performing bending forming on a material to be rolled formed with a crop part based on a both-drive system.
Figure 19:
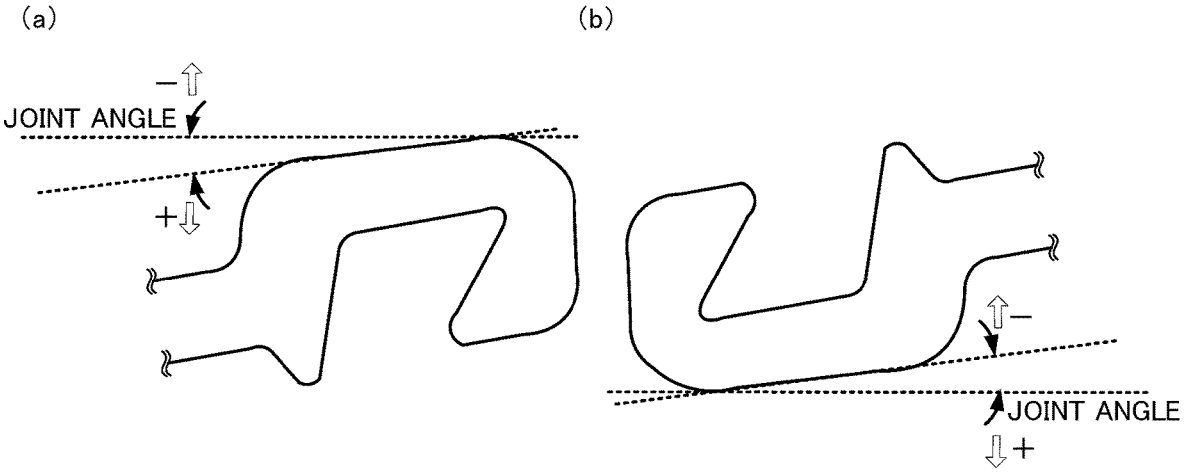
FIG. 19 are schematic explanatory views of joint angles.

As Examples, studies were conducted regarding the left-right unbalanced deformation when performing the bending forming on the material to be rolled formed with the crop part by using the bending machine of single-drive system, in the production of the hat-shaped steel sheet pile. FIG. 17 is a graph illustrating a dimensional change in the longitudinal direction of left and right joint angles when performing the bending forming on the material to be rolled formed with the crop part based on the single-drive system. FIG. 18 is a graph illustrating a dimensional change in the longitudinal direction of left and right joint angles when performing the bending forming on the material to be rolled formed with the crop part based on the both-drive system. Note that the (left and right) joint angles described in FIG. 17 and FIG. 18 are, as illustrated in FIG. 19, angles of bottoms of the left and right joints of the hat-shaped steel sheet pile with respect to the horizontal direction. Further, as illustrated in FIG. 19(*a*) and FIG. 19(*b*), a lower claw side indicates a joint having a downward-opening shape, and an upper claw side indicates a joint having an upward-opening shape.

As illustrated in FIG. 17, in the single-drive system, regarding the left and right joint angles, there is generated an angle difference of about 2° between left and right at the biting part (a dotted line part in the drawing). On the other hand, as illustrated in FIG. 18, in the both-drive system, regarding the left and right joint angles, no angle difference between left and right is generated at the biting part (a dotted line part in the drawing). Specifically, based on the comparison between FIG. 17 and FIG. 18, it was proved that, when performing the bending forming on the material to be rolled formed with the crop part, the left-right unbalanced deformation occurs in the single-drive system, and thus stable biting and bending forming are not performed.

In view of the results of Example, when the device of cutting the crop part is introduced into the rolling line as explained in the second other embodiment of the present invention, the formed crop part is cut, and then the bending forming is carried out, biting starting points of left and right always match, and thus it can be confirmed that, without depending on the drive system, the stable bending forming can be realized even in the single-drive system.

INDUSTRIAL APPLICABILITY

The present invention is applicable to a bending device of a steel sheet pile, a production facility for a steel sheet pile, a bending method of a steel sheet pile, and a production method for a steel sheet pile.

EXPLANATION OF CODES

10 . . . rough rolling mill
13 . . . first intermediate rolling mill
14 . . . edger rolling mill
16 . . . second intermediate rolling mill
17 . . . edger rolling mill
19 . . . finish rolling mill
19*a* . . . finished material
20 . . . bending device
21 . . . cooling equipment
22 . . . first stand
23 . . . second stand
40 . . . upper caliber roll
41 . . . lower caliber roll
44 . . . casing
45 . . . caliber
50 . . . upper caliber roll
51 . . . lower caliber roll
54 . . . casing
55 . . . caliber
60 . . . web corresponding part
62, 63 . . . flange corresponding part
65, 66 . . . arm corresponding part
68, 69 . . . joint corresponding part
70 . . . restraining die
71 . . . shearing blade
80 . . . bending device
83, 84, 88, 89 . . . lubricating oil supply mechanism
86 . . . control unit
90 . . . web corresponding part of U-shaped steel sheet pile
92 . . . claw part
100 . . . crop cutting machine
N . . . cooling spray nozzle
L . . . rolling line

What is claimed is:

1. A bending device which produces a hat-shaped steel sheet pile by performing bending on a material to be rolled after being subjected to rough rolling, intermediate rolling, and finish rolling in a hot state, in a direction of increasing a cross sectional height of the material to be rolled, the bending device comprising:

a forming stand comprising a forming caliber configured by an upper caliber roll and a lower caliber roll; and a drive unit driving either the upper caliber roll or the lower caliber roll;

wherein roll diameters of the upper caliber roll and the lower caliber roll are equal; and wherein the forming caliber is configured to change an angle made by a portion corresponding to a flange of the hat-shaped sheet pile and a portion corresponding to a web of the hat-shaped sheet pile.

2. The bending device according to claim 1, wherein a plurality of the forming stands are arranged in series.

3. The bending device according to claim 1, further comprising a lubricating oil supply mechanism supplying a lubricating oil to the upper caliber roll or the lower caliber roll that is not driven by the drive unit.

4. The bending device according to claim 1, further comprising:

lubricating oil supply mechanisms supplying a lubricating oil to the upper caliber roll and the lower caliber roll; and a control unit controlling a ratio between a lubricating oil supply amount with respect to the upper caliber roll and a lubricating oil supply amount with respect to the lower caliber roll.

5. The bending device according to claim 1, wherein:

when the material to be rolled is in a U-posture, the drive unit of driving the lower caliber roll is provided, and when the material to be rolled is in an inverted U-posture, the drive unit of driving the upper caliber roll is provided.

6. The bending device according to claim 2, wherein:

when the material to be rolled is in a U-posture, the drive unit of driving the lower caliber roll is provided, and when the material to be rolled is in an inverted U-posture, the drive unit of driving the upper caliber roll is provided.

7. The bending device according to claim 3, wherein:

when the material to be rolled is in a U-posture, the drive unit of driving the lower caliber roll is provided, and when the material to be rolled is in an inverted U-posture, the drive unit of driving the upper caliber roll is provided.

8. The bending device according to claim 4, wherein:

when the material to be rolled is in a U-posture, the drive unit of driving the lower caliber roll is provided, and when the material to be rolled is in an inverted U-posture, the drive unit of driving the upper caliber roll is provided.

9. A bending method, comprising performing bending on a material to be rolled after being subjected to rough rolling, intermediate rolling, and finish rolling in a hot state, in a direction of increasing a cross sectional height of the material to be rolled, to produce a hat-shaped steel sheet pile by changing an angle made by a portion corresponding to a flange of the hat-shaped sheet pile and a portion corresponding to a web of the hat-shaped sheet pile, wherein working is performed by driving, out of an upper caliber roll and a lower caliber roll that configure a forming caliber which performs the bending, only one of the rolls which presses the material to be rolled, and without driving the other roll, wherein roll diameters of the upper caliber roll and the lower caliber roll are equal.

10. The bending method according to claim 9, wherein a plurality of forming stands each comprising the forming caliber are arranged in series, and the bending is continuously performed in the plurality of forming stands.

11. The bending method according to claim 9, wherein a lubricating oil is supplied to the roll which is not driven, out of the upper caliber roll and the lower caliber roll.

12. The bending method according to claim 10, wherein a lubricating oil is supplied to the roll which is not driven, out of the upper caliber roll and the lower caliber roll.

13. The bending method according to claim 9, wherein a lubricating oil is supplied to the upper caliber roll and the lower caliber roll.

14. The bending method according to claim 10, wherein a lubricating oil is supplied to the upper caliber roll and the lower caliber roll.

15. The bending method according to claim 9, wherein the bending is performed in an arrangement where a position of a center of gravity of the material to be rolled is positioned in the vicinity of a roll center position of the upper caliber roll and the lower caliber roll.

16. The bending method according to claim 10, wherein the bending is performed in an arrangement where a position of a center of gravity of the material to be rolled is positioned in the vicinity of a roll center position of the upper caliber roll and the lower caliber roll.

17. The bending method according to claim 11, wherein the bending is performed in an arrangement where a position of a center of gravity of the material to be rolled is positioned in the vicinity of a roll center position of the upper caliber roll and the lower caliber roll.

18. The bending method according to claim 13, wherein the bending is performed in an arrangement where a position of a center of gravity of the material to be rolled is positioned in the vicinity of a roll center position of the upper caliber roll and the lower caliber roll.

* * * * *